United States Patent [19]

Carvin

[11] Patent Number: 4,850,283

[45] Date of Patent: Jul. 25, 1989

[54] SYSTEM TO PERMIT CARGO TO BE PRE-SLUNG AFTER WAREHOUSE PALLETIZATION

[76] Inventor: David A. Carvin, 7916 Skipper La., Tallahassee, Fla. 32301

[21] Appl. No.: 207,263

[22] Filed: Jun. 15, 1988

Related U.S. Application Data

[63] Continuation of Ser. No. 930,455, Nov. 14, 1986, abandoned.

[51] Int. Cl.[4] ..... B65D 19/00

[52] U.S. Cl. ..... 108/51.1; 108/52.1; 414/786

[58] Field of Search ..... 108/51.1, 53.3, 55.5, 108/53.1, 52.1, 56.3; 294/19.1, 26; 206/598, 599, 600; 414/403, 462, 786

[56] References Cited

U.S. PATENT DOCUMENTS

| | | | |
|---|---|---|---|
| 2,570,757 | 10/1951 | Bowman et al. | 108/52.1 X |
| 2,870,981 | 1/1959 | Dellinger et al. | 108/52.1 |
| 2,896,798 | 7/1959 | Celley | 108/52.1 x |
| 2,906,480 | 9/1959 | Rowe | 108/52.1 |
| 3,112,715 | 12/1963 | Callahan et al. | 108/52.1 X |
| 3,411,434 | 11/1968 | Sylvester et al. | 108/52.1 X |
| 3,507,415 | 4/1970 | Mankey | 108/55.3 X |
| 3,936,088 | 2/1976 | Williams | 294/19 R |
| 4,200,322 | 4/1980 | Smith | 294/19 R |
| 4,354,599 | 10/1982 | Brown et al. | 108/53.1 X |
| 4,543,035 | 9/1985 | Lair | 108/55.1 X |
| 4,688,979 | 8/1987 | Kupersmit | 414/403 |

*Primary Examiner*—Kenneth J. Dorner
*Assistant Examiner*—José V. Chen
*Attorney, Agent, or Firm*—Bell, Seltzer, Park & Gibson

[57] ABSTRACT

A system of facilitating the handling of bagged cargo normally stored in any applicable facility on pallets wherein the system includes the formation of elongated passages through the provision of removable or fixed channel members disposed in sandwiched relation between the under portion of the bagged cargo and the supporting surface of the pallet and the inclusion of a plurality of sling members positionable along the length of the passages and connectable to a lifting crane when it is desired to vertically transport the cargo as by lifting crane to the hold of a cargo ship. The channel members are adaptable to the pallet without modifying the construction or necessitating the discarding of standard pallet construction in favor of newly designed or structured pallets.

5 Claims, 1 Drawing Sheet

SYSTEM TO PERMIT CARGO TO BE PRE-SLUNG AFTER WAREHOUSE PALLETIZATION

This application is a continuation of application Ser. No. 930,455, filed Nov. 14, 1986, now abandoned.

BACKGROUND OF THE INVENTION

1. Field of the Invention

This invention relates to a system for bagged cargo to be pre-slung subsequent to placing or storing the cargo on standard pallets and incorporates a plurality of channel members either removably or fixedly secured to the pallet to define the passage beneath the cargo for placement of sling members thereunder and for further cooperation of the sling members with a lifting crane if such is required.

2. Description of the Prior Art

The primary objective of a ship stevedore is to load cargo as quickly as possible. To facilitate the loading procedure and accomplish high tonage rates, bagged cargo is "unitized" in boxes, pallets and especially with the use of cloverleaf slings. Utilizing the techniques referred to above has resulted in a doubling of productivity rates over individual bag handling. However, there is an inherent and well recognized problem of utilizing unitizing slings. This is directed primarily to the added expense of such slings. In addition, many cargo ship configurations and attendant loading gear do not lend themselves to the handling of unitized cargo.

Upon the arrival of cargo to a port, which generally occurs by railroad car, the cargo and more specifically the bags of cargo are discharged or transferred to warehouse pallets. Utilizing the aforementioned methods and apparatus to render cargo handling more efficient, such as putting slings on the pallet loads, shown down the rail discharge. This in turn results in additional expense due to the fees and charges for this service. Another problem encountered is the frequent arrival of cargo in port before a specific vessel has been determined for the transport of such cargo. Accordingly, in situations of this type, the stevedore does not known whether such unitization of the cargo should in fact take place since the ship's configuration and loading equipment is unknown.

In order to overcome certain of the above set forth disadvantages, the prior art is replete with pallets having various designs primarily directed towards accomplishing, handling or even the use of unitizing slings in a manner which would be more advantageous. However, many of the prior art devices are primarily directed to redesigning the standard pallet structural configuration. This in turn would necessitate the abandoning large numbers of existing standard pallets, resulting in the loss of many hundreds of thousands of dollars in many cases. Also, additional sums of capital would have to be expended for the investment of a similar large number of pallets of new design. The following U.S. patents are directed towards handling systems and apparatus generally representative of the prior art: Bowman, U.S. Pat. No. 2,570,757; Shell, U.S. Pat. No. 3,380,404; Halteman, U.S. Pat. No. 1,777,694; Ulinski, U.S. Pat. No. 2,412,184 and Arthur, U.S. Pat. No. 2,463,588.

Even in light of the structures of the type disclosed in the aforementioned patents, there is still a need in the shipping industry for a structure which will facilitate the handling of cargo especially of the type where bagged cargo is unitized to the extent of being lifted and separated completely from a standard pallet with a minimal amount of time, modified structure and expense involved and utilizing conventional loading and lifting equipment such as lifting cranes associated with shipping of conventional configuration.

SUMMARY OF THE INVENTION

The present invention relates to a system for handling cargo including the storage of cargo on pallets in a manner which readily facilitates and makes more efficient the applying of sling members to bagged cargo or unitized cargo so that conventional loading equipment such as a lifting crane may be secured to the unitized cargo for the transfer of the cargo from the pallet to the storage facility on a cargo ship or the like.

The system of the present invention contemplates the formation of elongated passages on the supporting surface of a pallet and beneath the bagged cargo wherein the passages are specifically disposed and dimensioned to receive and allow placement there through of sling members. The sling members, after being disposed into and along the length of the passages are of sufficient length to be draped in surrounding relation about the unitized cargo and connected to a conventional loading facility, such as lifting crane. Operation of the lifting crane thereby serves to efficiently and effectively remove the cargo from its previously stored position on the pallet and transfer the cargo initially in a vertical orientation from the pallet to the storage facility on a cargo ship.

Therefore, it should be readily apparent that the formation of the passages beneath the cargo and above or over the supporting surface of the pallet will enable the placement of the sling in surrounding and potentially supporting relation to the cargo subsequent to loading of the cargo on the pallet such as when it is first received in a storage facility at a given port. This eliminates many problems existing in the shipping industry such as when the stevedore or loading personnel are not aware of whether the cargo should be unitized at the time of unloading or placing on the plallet. If the cargo is to be otherwise handled or transported without utilizing a unitized method including a plurality of slings, no time has been wasted in placing the cargo on the supporting surface of the pallet with the passages formed thereon.

Accordingly, an important feature of the present invention is the formation of the aforementioned passages through the provision of a plurality of channel members which may in one embodiment take the form of elongated half tubes or "semi-tubes" extending between opposite ends of the pallet and in parallel spaced relationship to opposite sides of the pallet. Each of the semi-tubes or channel members has oppositely disposed open ends communicating with or positioned in general registry with the opposite ends of the pallet and the cargo placed thereon. Such open ends are clearly accessible for the passage there through of the elongated sling members capable of being used in combination with the conventional loading equipment such as lifting cranes or the like.

In order to accomplish the passage of the slings through the individual pallet, an elongated rod having a specifically formed end may first be pushed into and along the length of the passage through an appropriate open end of the aforementioned channel members. The specifically formed end engages a fastening member secured to one end of one sling member and the sling member is then pulled or drawn through the appropriate channel member along the length of the passage. Again, the length of each of the sling members such as to be draped over the bottom and sides of the bagged cargo and each of the opposite ends of the sling member as a fastening member or eyelet secured thereto for connection to lifting hook associated with the loading crane, etc. In this embodiment the "semi-tubes" may be made of a lightweight ridged yet relatively high strength material capable of maintaining their structural configuration while still being placed in sandwiched relation beneath the cargo and on top of the supporting surface of the pallet. Once the cargo has been removed the semi-tubes can be reused since they may be removably positioned on the supporting surface of the pallet rather than being fastened thereto.

In another embodiment of the present invention, each of the channel members may be formed by two ridgedly secured members fixedly attached, as by nails, screws, bolts, etc. In parallel spaced apart relation to one another, wherein the spacing between the two fixed members defines the aforementioned elongated passage extending between the opposite ends of the pallet. In this embodiment, expensive modification to a conventional pallet structure need not be made. Rather, the aforementioned members forming the channel members are permanently affixed to the supporting surface in the manner described above.

The invention accordingly comprises the features of construction, combination of elements and an arrangement of parts which will be exemplified in the construction hereinafter set forth, and the scope of the invention will be indicated in the claims.

BRIEF DESCRIPTION OF THE DRAWINGS

For a fuller understanding of the invention, reference should be made to the following detailed description take in connection with the accompanying drawings in which.

Like reference numerals are used to refer to like parts throughout the several views of the drawings.

DETAILED DESCRIPTION OF PREFERRED EMBODIMENT

Figure 1:
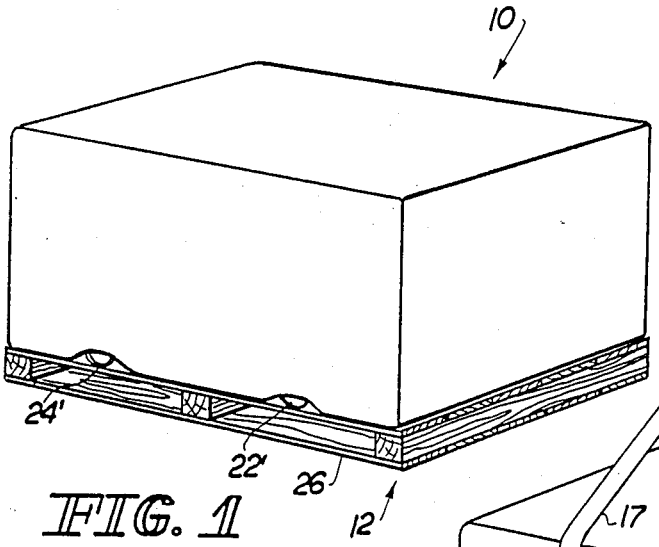
FIG. 1 is a perspective view of bagged or unitized cargo mounted on the supporting surface of a conventional pallet with channel members of the present invention positioned between the pallet and the cargo.
Figure 2:
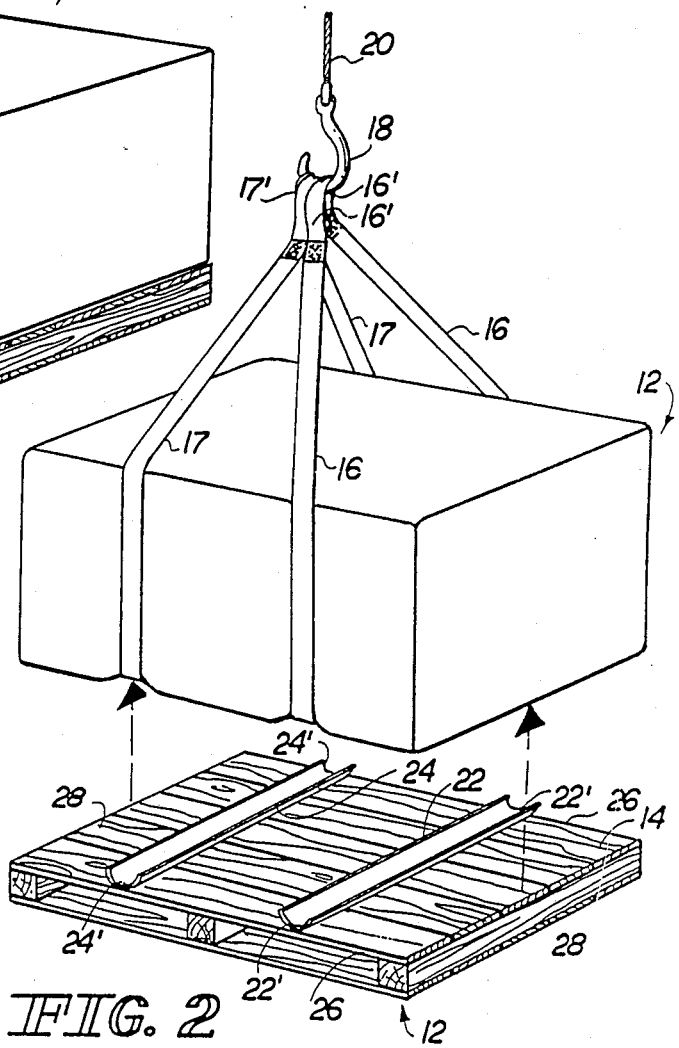
FIG. 2 is a perspective view of the cargo being removed through the utilization of a plurality of slings, previously having passed through passages formed by the channel members of the present invention.
Figure 3:
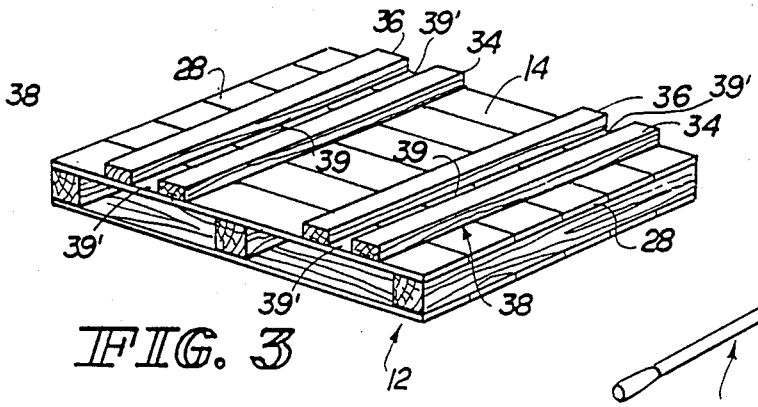
FIG. 3 is a perspective view of another embodiment of the channel members of the present invention.
Figure 4:
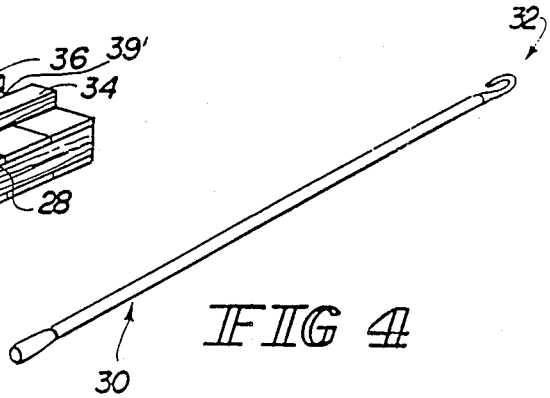
FIG. 4 is a perspective view of a pull rod associated with the channel members of the present invention as specifically structured to apply the plurality of sling in the manner described in greater detail hereinafter.

As shown in FIGS. 1 through 3 the system of the present invention is directed towards loading and unloading and generally handling of bagged or unitized cargo as generally indicated as 10. Such cargo is first placed for storage on a substantially conventional pallet structure 12 having a supporting surface 14 of a flat or planar configuration. The system of the present invention provides for the maintenance of elongated passages extending beneath the cargo 10 and above the pallet 12 or more specifically beneath the caro 10 and the supporting surface 14. These passages are provided so as to properly position a plurality of sling members 16 and 17 along the passages and in a draped and at least partially surrounding and containing configuration over the cargo 12. Further, each of the slings 16 and 17 include fasteners in the form of eyelets 16' and 17' at each opposite end of the respective sling members 16 and 17. The eyelets or fastening members 16' and 17' are therefore positionable into cooperative relation with one another so as to be engaged by a hook 18 attached to a hoist line 20 which may be part of a conventional loading equipment or facility such as a lifting crane or the like.

Accordingly, in order to define and maintain the aforementioned passages, the system of the present invention contemplates the provision of a plurality of channel members 22 and 24 having an elongated configuration and extending between and in communication with opposite ends 26 of the conventional pallet structure 12 and in spaced, substantially parallel relation to opposite sides 28 of the pallet structure 12. Each of the channel members 22 and 24 are removably disposed in the aforementioned position as shown in FIG. 2 prior to the cargo 10 being placed thereon. Further, each of the channel members 22 and 24 are further defined by a substantially U-shaped cross sectional configuration extending along their respective lengths and open ends 22' and 24' respectively at each of the opposite ends thereof.

As shown in FIG. 1 each of the open ends 22' and 24' are disposed in accessible relation to the corresponding ends 26 of the pallet structure 12 and to the side of the cargo 10. This allows placement and passage there through of the sling members 16 and 17 if in fact it is desired to use the loading equipment such as a lifting crane and the sling members 16 and 17 in the manner described with regard to FIG. 2.

If the sling members 16 and 17 are desired to be used, an elongated rod generally indicated as 30, is provided with a sufficient longitudinal dimension to extend completely through either one of the channel members 22 or 24. A connector means 32 is integrally or otherwise formed on the distal end of the rod 30 and is specifically shaped into a hook or any applicable configuration so as to removably engage one of the fasteners or eyelet members 16' or 17' of the respective sling members 16 or 17. Once so engaged the sling member is drawn or pulled back through the passage to find either one of the respective channel members 22 or 24 until the corresponding fastener or eyelet 16' or 17' is present at the other opposite end of the pallet 12. The sling member is thereby effectively "centered" until the orientation is achieved as best shown in FIG. 2.

It should be readily apparent, however, that the cargo 10 can be otherwise handled as long as it is first loaded onto the pallet 12 with the channel members 22 and 24 already in place. The fact that the channel members 22 and 24 of the embodiment of FIG. 2 are removably secured to the support surface 14 allows reuse of these channel members. In one embodiment of the channel members 22 and 24 may be formed of a lightweight, rigid and yet relatively high strength material such as cardboard, paperboard, etc., wherein the rigidity and strength of the individual members 22 and 24 is sufficient to maintain the aforementioned U-shaped cross sectional configuration even when the cargo 10 is placed on top of the channel members 22 and 24 as shown in FIG. 2, such that the open side of the U-shaped cross sectional configuration faces towards the cargo 10 as best shown in FIG. 2.

Another embodiment of the present invention contemplates the use of fixed members 34 and 36 to form each channel member generally indicated as 38, wherein the individual members 34 and 36 are disposed in spaced apart, parallel relation to one another and the two channel members designated generally as 38 are disposed in spaced, parallel relation to each other and to the opposite sides 28 of the pallet 12. The spacing between the members 34 and 36 define the aforementioned passage through which slings 16 and 17 may pass in the manner set forth with regard to the description of the embodiment of FIG. 2. The passage or spacing 39 is of a consistent dimension throughout the length of the respective channel members 38 and the open ends 39' are accessible to facilitate placement of the slings 16 and 17 in the manner shown in FIG. 2 with the use of the rod 30 as described above.

Fixed positioning of the members 34 and 36 in the manner described may be accomplished by adhesive, fasteners (not shown for the purposes of clarity) or any means which will maintain the members in the fixed position shown in FIG. 3.

What is claimed is:

1. A method of loading a cargo load, comprising the steps of providing a supporting pallet having a generally flat upper supporting surface, and a generally rectangular outline so as to define a pair of opposite parallel sides, positioning a plurality of channel members upon said supporting surface so as to be free of any fixed interconnection therewith, wiht said channel members being disposed in a parallel, laterally spaced apart arrangement extending between said opposite sides of said pallet, and with each of said channel members having open opposite ends, positioning a cargo load upon said supporting surface of said pallet ad overlying said channel members, and with said opposite ends of each of said channel members being open and accessible, and so that each of said channel members defines an open passage along its length extending beneath said cargo load and between said opposite sides of said pallet, and then threading a sling member through the open passage of each of said channel members so as to underlie the cargo load, and extending the ends of the sling members upwardly so as to be positioned partially about the cargo load, and then attaching the ends of the sling members to a lifting crane or the like and lifting the cargo from said pallet.

2. The method as claimed in claim 1 wherein the step of threading a sling member through the open passage of each of said channel members includes passing one end of an elongate rod through the open passage of each of said channel members, with the elongate rod having connecting means at said one end thereof, engaging the sling member with said connecting means, and withdrawing the rod and engaged sling member back through the open passage.

3. The method as defined in claim 2 wherein said supporting pallet includes slots extending parallel to and below said upper supporting surface and adapted for receiving fork lifts.

4. The method as defined in claim 1 wherein at least two of said channel members are positioned upon said supporting surface, and said two channel members are free of any interconnection therebetween.

5. The method as defined in claim 4 wherein each of said channel members is upwardly open.

* * * * *

UNITED STATES PATENT AND TRADEMARK OFFICE

CERTIFICATE OF CORRECTION

PATENT NO. : 4,850,283

DATED : July 25, 1989

INVENTOR(S) : David A. Carvin

It is certified that error appears in the above-identified patent and that said Letters Patent is hereby corrected as shown below:

On the title, item [57] ABSTRACT:

Line 10, after "by", add --a--.

Column 1, line 14, after "the" (first occurrence), delete "passage" and insert --passages--.

Column 1, line 36, after "loads," delete "shown" and insert --slows--.

Column 1, line 42, after "not", delete "known" and insert --know--.

Column 2, line 67, after "channel", delete "members." and insert --member.--.

Column 3, line 39, delete "take" and insert --taken--.

Column 4, line 12, after "of", delete --a--.

Column 5, line 35, after "therewith,", delete "wiht" and insert --with--.

Column 6, line 4, after "pallet", delete "ad" and insert --and--.

Signed and Sealed this

Twenty-ninth Day of May, 1990

*Attest:*

HARRY F. MANBECK, JR.

*Attesting Officer*

*Commissioner of Patents and Trademarks*